US011343900B2

(12) United States Patent
Wampler et al.

(10) Patent No.: US 11,343,900 B2
(45) Date of Patent: May 24, 2022

(54) THIN-FILM TARGET FOR DT NEUTRON PRODUCTION

(71) Applicant: National Technology & Engineering Solutions of Sandia, LLC, Albuquerque, NM (US)

(72) Inventors: William R. Wampler, Albuquerque, NM (US); Barney L. Doyle, Albuquerque, NM (US); Clark S. Snow, Albuquerque, NM (US)

(73) Assignee: National Technology & Engineering Solutions of Sandia, LLC, Albuquerque, NM (US)

( * ) Notice: Subject to any disclaimer, the term of this patent is extended or adjusted under 35 U.S.C. 154(b) by 82 days.

(21) Appl. No.: 16/930,514

(22) Filed: Jul. 16, 2020

(65) Prior Publication Data

US 2021/0022237 A1 Jan. 21, 2021

Related U.S. Application Data

(60) Provisional application No. 62/875,328, filed on Jul. 17, 2019.

(51) Int. Cl.

| | |
|---|---|
| ***H05H 6/00*** | (2006.01) |
| *H05H 3/06* | (2006.01) |
| *G21G 4/02* | (2006.01) |

(52) U.S. Cl.

CPC ..... *H05H 6/00* (2013.01); *G21G 4/02* (2013.01); *H05H 3/06* (2013.01)

(58) Field of Classification Search

CPC ..... H05H 6/00

See application file for complete search history.

(56) References Cited

U.S. PATENT DOCUMENTS

| | | | | |
|---|---|---|---|---|
| 3,320,422 A * | 5/1967 | St John | ..... | H05H 6/00 376/151 |
| 3,646,348 A * | 2/1972 | Detaint | ..... | H05H 6/00 376/151 |
| 4,298,804 A * | 11/1981 | Colditz | ..... | H05H 3/06 376/151 |

OTHER PUBLICATIONS

Hughey, B.J., "A long-lived tritiated titanium target for fast neuron production," Nuclear INstruments and Methods in Physics Research B 95 (1995), pp. 393-401.

* cited by examiner

*Primary Examiner* — Sharon M Davis
(74) *Attorney, Agent, or Firm* — Kevin W. Bieg

(57) ABSTRACT

A novel thin-film target can the life of tritium targets for the production of 14 MeV neutrons by the $^{3}H(^{2}H,n)^{4}He$ nuclear reaction while using only a small fraction of the amount of tritium compared to a standard thick-film target. With the thin-film target, the incident deuterium is implanted through the front tritide film into the underlying substrate material. A thin permeation barrier layer between the tritide film and substrate reduces the rate of tritium loss from the tritide film. As an example, good thin-film target performance was achieved using W and Fe for the barrier and substrate materials, respectively.

5 Claims, 8 Drawing Sheets

THIN-FILM TARGET FOR DT NEUTRON PRODUCTION

CROSS-REFERENCE TO RELATED APPLICATION

This application claims the benefit of U.S. Provisional Application No. 62/875,328, filed Jul. 17, 2019, which is incorporated herein by reference.

STATEMENT OF GOVERNMENT INTEREST

This invention was made with Government support under Contract No. DE-NA0003525 awarded by the United States Department of Energy/National Nuclear Security Administration. The Government has certain rights in the invention.

FIELD OF THE INVENTION

The present invention relates to DT neutron production and, in particular, to a thin-film target for DT neutron production.

BACKGROUND OF THE INVENTION

A standard method for producing 14 MeV neutrons is to use the $^3H(^2H,n)^4He$ (i.e., T(D,n)α) nuclear reaction with a deuterium (D) ion beam on a thick metal-tritide target. See J. Csikai, *CRC Handbook of Fast Neutron Generators*, Vol 1, CRC Press (1987). With this method, the neutron yield decreases with time due to tritium (T) loss from the target by isotope exchange, necessitating frequent target replacement.

Therefore, there is a need for a new target configuration that extends target lifetime while reducing tritium usage.

SUMMARY OF THE INVENTION

The present invention is directed to a thin-film target for DT neutron production, comprising a substrate comprising a high D permeability material, a permeation barrier layer comprising a low D permeability material on the substrate to inhibit D permeation from the substrate therethrough, and a front-surface tritide layer on the permeation barrier layer that reacts with an incident D beam to produce DT neutrons, wherein the combined thickness of the tritide layer and the permeation barrier layer is less than the range of the incident D beam. Preferably, the D permeability of the permeation barrier material is at least five orders-of-magnitude less than that of the substrate material. The thicknesses of the tritide and the permeation barrier layer can be selected to simultaneously maximize T(D,n)α reaction yield in the tritide layer, maximize D implantation into the substrate, and minimize D permeation from the substrate through the permeation barrier layer to the tritide layer.

The life time of thick- and thin-targets were compared for production of 14 MeV neutrons by the T(D,N)α nuclear reaction. With thick film targets, the target life was maximized by operating a titanium tritide target at a temperature of 150° C., where diffusion is fast enough that the implanted D mixes with the tritium throughout the entire thickness of the film. With the thick-film target, the neutron production rate decreased with time as expected due to isotope exchange of tritium in the film with the implanted deuterium, and the number of neutrons obtained from a target is proportional to the initial tritium content of the film. With the thin-film target of the present invention, the incident deuterium is implanted through the tritide and into the underlying substrate material. A thin permeation barrier layer between the tritide film and substrate reduces the rate of tritium loss from the tritide film. Solubility, diffusivity, and permeability of deuterium are important properties in choosing suitable materials for the barrier and substrate. As an example, good thin-film target performance was achieved using W and Fe for the barrier and substrate materials, respectively. The thin-film targets can produce similar number of neutrons as thick-film targets while using only a small fraction of the amount of tritium.

BRIEF DESCRIPTION OF THE DRAWINGS

The detailed description will refer to the following drawings, wherein like elements are referred to by like numbers.

DETAILED DESCRIPTION OF THE INVENTION

Figure 1:
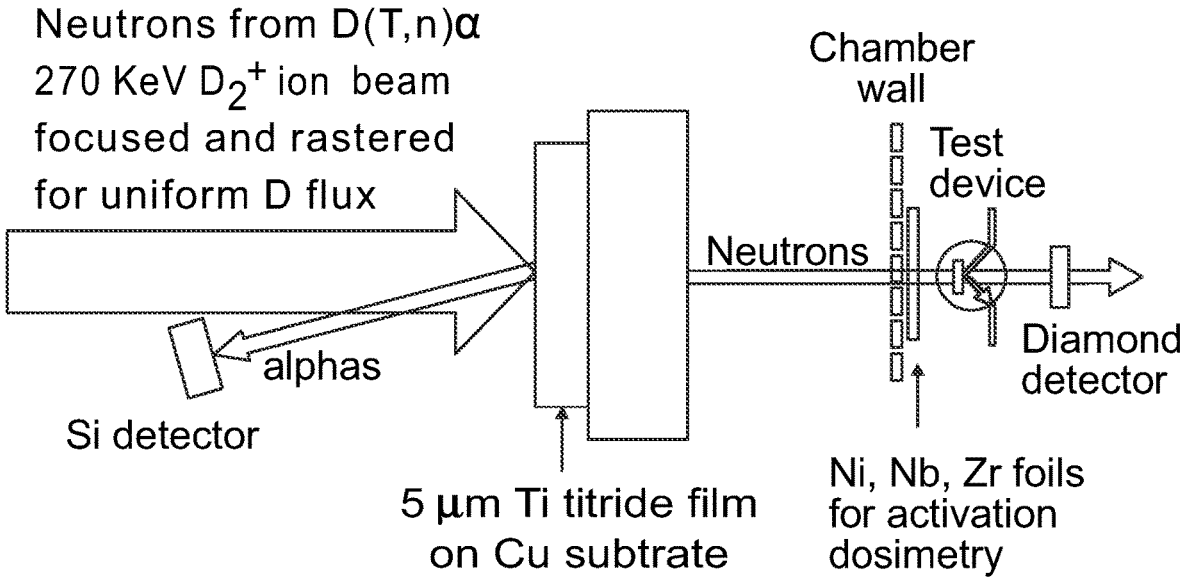
FIG. 1 is a schematic illustration of a setup to produce DT neutrons from a thick-film target for neutron irradiation of a test device.

FIG. 1 shows a setup for producing DT neutrons from a standard thick-film for neutron irradiation of a test device. The thick-film target comprises a 5-μm thick titanium tritide film on a copper substrate. A 270 keV $D_2^+$ ion beam can be focused and rastered on the target for uniform D flux. The thick-film target temperature is typically controlled at 150° C. during operation. Neutron production rate and fluence can be independently determined by a variety of diagnostics. The neutron production rate can be determined in real time from the alpha yield measured by a silicon detector. Neutron flux can also be measured directly in real time with a diamond detector that can have a flexible location outside of the target vacuum chamber. Total fluence can be determined by measuring dosimetry foil activity at the end of irradiation. Finally, initial reaction yield can be calculated from the DT reaction cross section, D beam current, and initial tritium content of the film.

The 'thick-film' target uses a tritide film whose thickness is greater than the range of the incident deuterium. For such thick-film targets, the lifetime is increased by operating the target at an elevated temperature where the diffusivity of D and T in the tritide film is sufficiently fast that the two isotopes continuously mix throughout the entire thickness of the film by thermal diffusion. Isotope exchange then occurs with the entire tritium content of the film, whereas at lower temperature the exchange occurs only within the range of implantation. As described below, tests with thick-film targets confirm that the change in the rate of neutron production versus time agrees with a dilution model based on isotope exchange and isotope mixing by diffusion. The number of neutrons that can be produced from a thick-film target is proportional to the initial quantity of T in the target undergoing exchange.

Conversely, a 'thin-film' target uses a tritide film that is thin enough so that the incident D passes through it and is implanted into the underlying substrate material. According to the present invention, thermal diffusion of implanted D back into the tritide film is inhibited by a thin barrier layer with low D permeation between the tritide and substrate, and by using a substrate material in which D permeation is high. This invention reduces the rate of tritium loss from the thin-film target and therefore extends the target lifetime. Moreover, the use of a thin tritide film reduces the quantity of T in the target and the quantity of T used during operation of the neutron production facility.

A concept using a thin-film target to reduce T loss rate was suggested previously, but was not experimentally demonstrated to improve lifetime of a tritide target. See B. J. Hughey, *Nucl. Instr. Meth.* B95, 393 (1995). An essential new feature of the present invention is the permeation barrier between the tritide film and the substrate. Without this barrier, D implanted into the substrate would diffuse to the tritide, since that is by far the shortest diffusion path for release, where it would mix with T and cause a similar high rate of T loss as from a thick-film target. Selection of the type of material for the substrate and the barrier is critical to the performance of the novel thin-film target and is driven by the diffusivity and solubility of D and other criteria, as described below. Exemplary thin-film tritide targets were fabricated using various materials for the substrate and permeation barrier. The neutron production rate versus time was measured for these thin-film targets and compared to that of thick-film targets. With a suitable choice of materials, the lifetime of thin-film targets can equal or exceed that of thick-film targets while using a small fraction of the amount of tritium per target.

Thick-Film Targets

Figure 2:
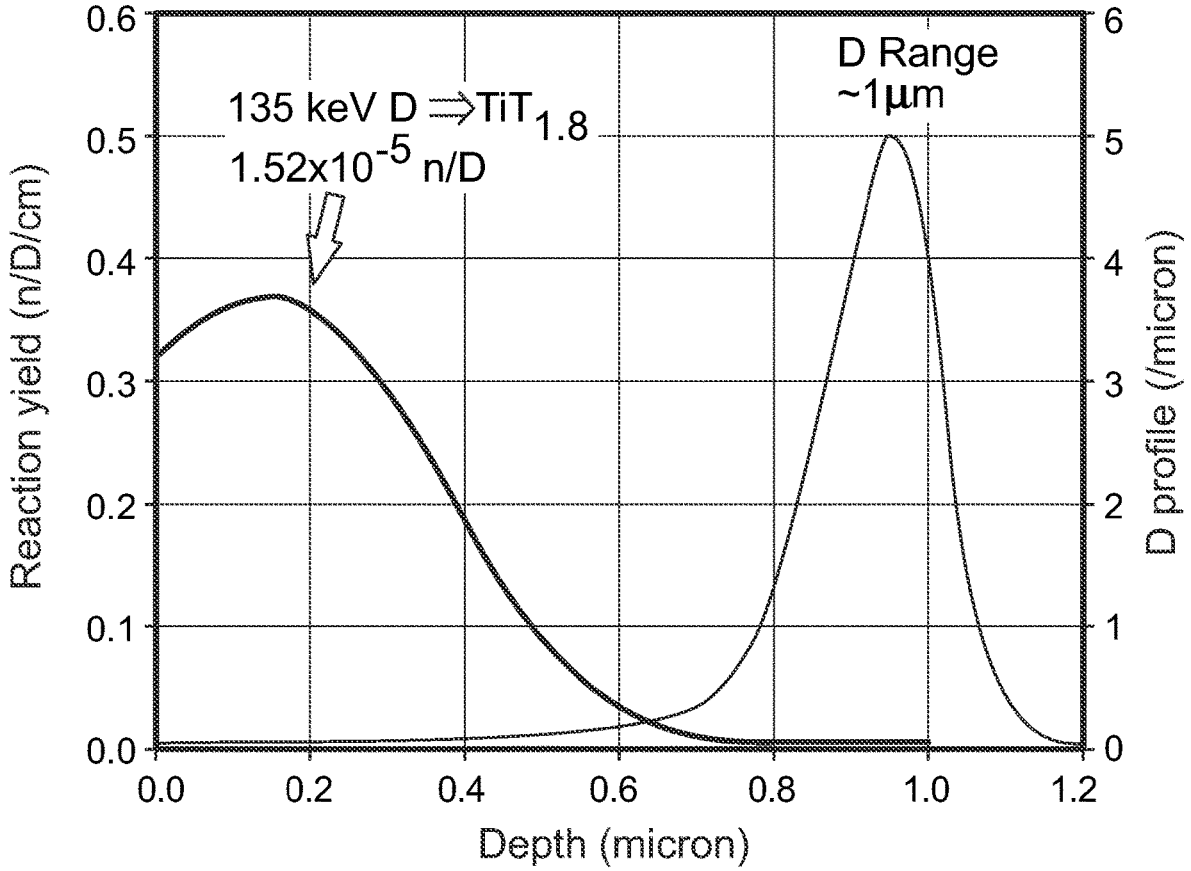
FIG. 2 is a graph of the neutron yield (solid curve) and range profile (dashed curve) for 135 keV D on $TiT_{1.8}$.
Figure 3:
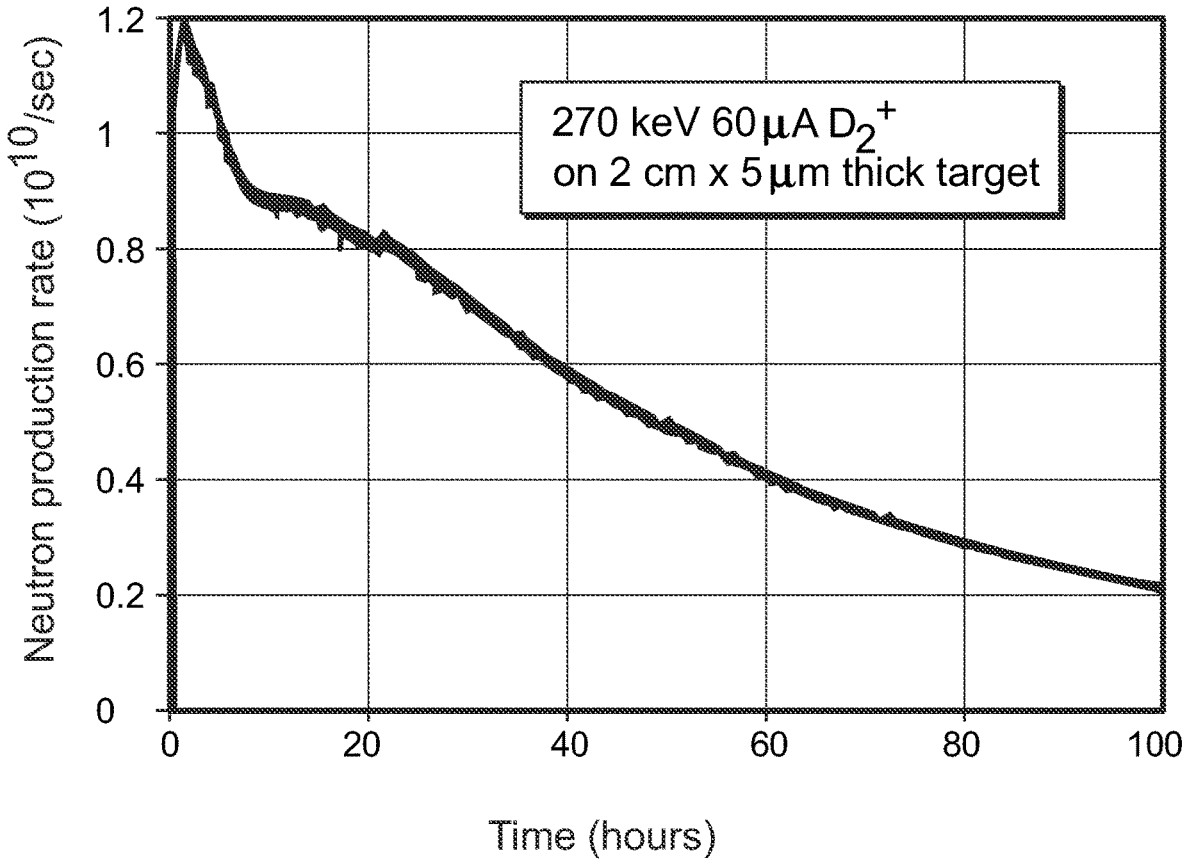
FIG. 3 is a graph of neutron production rate, determined from yield of associated alpha particles, versus time of D beam exposure for a thick-film target.

The behavior of a thick-film target in which the tritide film thickness is greater than the range of the incident D was examined. An exemplary thick-film target comprised a titanium tritide film, 2 cm in diameter and 5 microns thick, on a copper substrate, loaded to a concentration of $TiT_{1.8}$ by equilibration of a vapor-deposited titanium film with $T_2$ gas at elevated temperature. FIG. 2 shows the D range profile (dashed curve) for a D energy per atom of 135 keV, calculated from the SRIM particle transport code. See J. F. Ziegler et al., *SRIM—The Stopping and Range of Ions in Matter* (2008). Also shown is the DT nuclear reaction yield (solid curve), i.e. the number of reactions or neutrons produced per incident D atom per unit depth, calculated using the known energy-dependent nuclear reaction cross section and stopping power. See H. S. Bosch and G. M. Hale, *Nucl. Fusion* 32, 611 (1992); G. S. Chulick et al., *Nucl. Phys. A* 551, 255 (1993); and J. F. Ziegler et al., *SRIM—The Stopping and Range of Ions in Matter* (2008). Integrated over depth this gives a neutron production rate of $1.52\times10^{-5}$ neutrons per incident D atom, corresponding to $1.1\times10^{10}$ neutron/second from a 60 microamp $D_2^+$ ion beam, which is close to the initial rate measured experimentally with a fresh target, as shown in FIG. 3. Note that most of the neutrons are produced in the first 0.5 micron, whereas the range of the implanted D is near 1 micron.

As shown in FIG. 3, the neutron yield decreases with time of D beam exposure, due to displacement of tritium by D implanted from the beam. The total concentration of D+T is limited to that of the dihydride phase. See W. M. Mueller et al., *Metal Hydrides*, Academic Press (1968). Hence as D is implanted, an equal quantity of D+T is released from the film. For target temperatures below 100° C. the DT isotope exchange occurs within a fraction of the total film thickness, since at lower temperatures the time for DT mixing by thermal diffusion is longer than the time for T loss by isotope exchange within the 1 μm range of D. However, raising the target temperature to 150° C. increases the diffusion sufficiently that DT mixing by thermal diffusion occurs throughout the full 5 μm thickness of the film. See H. Wipf et al., *J. Alloys Compd.* 310, 190 (2000). This increases the quantity of tritium undergoing exchange which increases the target lifetime, slowing the decline in neutron production rate. Thermally activated release of tritium is negligible at this temperature. Target lifetime is increased further by focusing and rastering the D beam to obtain uniform average beam current density over the entire area of the tritide film. Beam focusing can use a magnetic quadrupole lens and electromagnetic deflection can be used to raster the beam over the target in horizontal and vertical directions.

Under these conditions the neutron production rate is proportional to the tritium concentration which is uniform throughout the film and decreases as deuterium is added and tritium is lost from the reservoir, which is a classic dilution problem. The amount of tritium remaining $$N_T = N \exp\left(-\frac{N_{Di}}{N}\right) \tag{1}$$

decreases exponentially with the amount of implanted deuterium $N_{Di}$. The number of neutrons $N_n$ produced per incident D is given by:

$$\frac{dN_n}{dN_{Di}} = \sigma\frac{N_T}{N} = \sigma \exp\left(-\frac{N_{Di}}{N}\right) \tag{2}$$

where $N=N_D+N_T$ is the quantity of D+T in the film which is also the initial quantity of tritium (the total number of D+T atoms in the target is constant, as determined by the stoichiometry and volume), and σ is the initial rate (neutrons per incident D) whose value is given in FIG. 2. The integrated number of neutrons produced is:

$$N_n = \sigma N \left(1 - \exp\left(-\frac{N_{Di}}{N}\right)\right) \tag{3}$$

Figure 4:
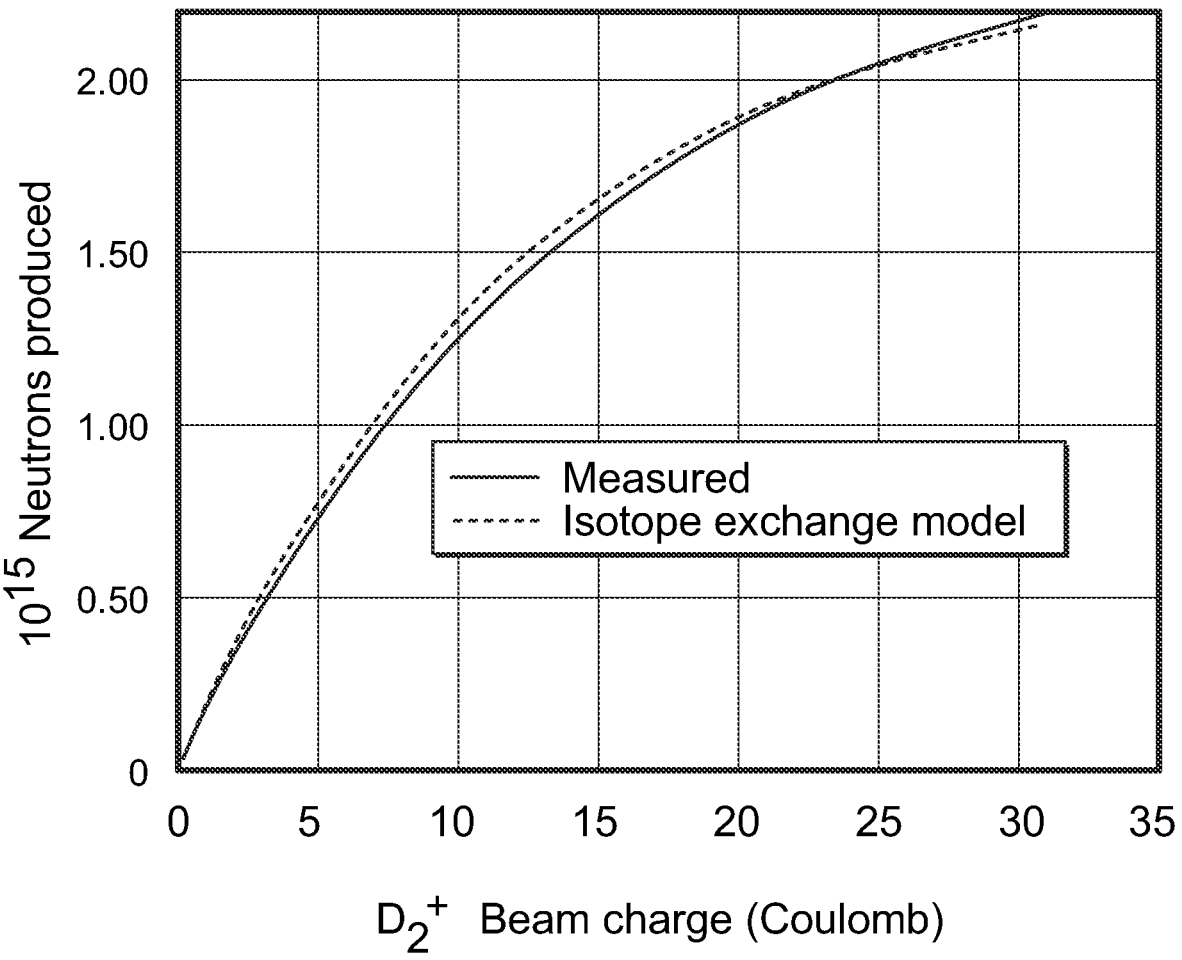
FIG. 4 is a graph of neutrons produced versus incident deuterium, measured (solid curve) and fit to the isotope exchange model (dashed curve).

The solid curve in FIG. 4 shows the experimentally observed integrated number of neutrons produced, determined from the alpha yield, versus integrated beam charge, which is proportional to $N_{Di}$. The total number of neutrons produced was $2.2\times10^{15}$. The total neutron fluence was about $3\times10^{12}/cm^2$ at a test location just outside the test chamber 3 inches from the source. Many other tests with similar targets gave very similar results. Since the neutrons are emitted nearly isotropically, the neutron flux at a test location is close to that from a point source at distances greater than the diameter of the source. See J. Csikai, *CRC Handbook of Fast Neutron Generators*, Vol 1, CRC Press (1987). The dashed curve in FIG. 4 is a fit of Eq. (3) to the data varying only N. The value of N obtained from this fit is within 10% of the value calculated from the atomic density of T times the volume of the tritide film. The excellent quantitative agreement validates the isotope exchange model for target lifetime. The model shows that the number of neutrons that can be obtained from a target σN can be increased only by increasing N, the initial quantity of T in the target, i.e the volume of the tritide film.

Thin-Film Targets

Figure 5:
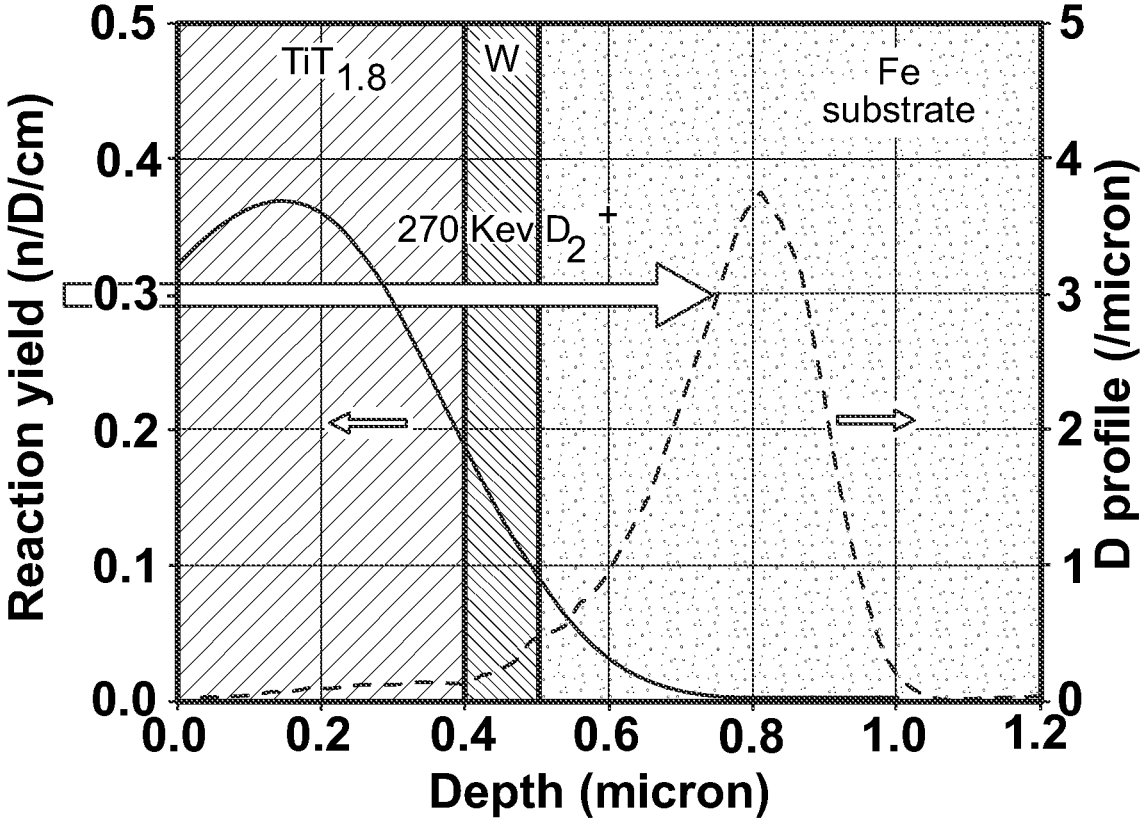
FIG. 5 is a graph of depth profile of implanted D from a SRIM simulation for the thin-film target configuration (dashed curve) and the DT reaction yield vs depth for a thick tritide target (solid curve).

The thick-film targets have the drawbacks that they must be replaced after a few days of use and they release about 7 Curies of tritium per target during use. The present invention is directed to a novel thin-film target that provides a longer target lifetime with less tritium usage. These thin-film targets use a tritide film thin enough so that most of the incident D passes through it and is implanted into a substrate material in which D can rapidly diffuse. An exemplary thin-film target that was developed and tested is shown in FIG. 5. This exemplary target used a titanium tritide film 0.4 microns thick and with the same lateral dimensions as the thick-film target, 2 cm diameter for the tritide film and 2.5 cm diameter for the substrate. Since most of the neutron yield from a thick-film target is within 0.5 micron (see FIG. 2), the initial neutron yield from thin-film targets is only slightly lower than from a thick-film target. A thin-film target concept was suggested previously, though was not demonstrated to improve lifetime of a tritide target. See B. J. Hughey, *Nucl. Instr. Meth.* B95, 393 (1995). However, an essential new feature of the thin-film target of the present invention is an additional thin layer of material between the tritide film and the substrate which has very low permeability for hydrogen. This layer acts as a permeation barrier and impedes diffusion of deuterium from the substrate into the tritide. Without this barrier, the implanted D would diffuse to the tritide, since that is by far the shortest distance, and cause tritium release. Selection of the type of material for the substrate and barrier is critical and is dictated by diffusion and solubility of D and other criteria. As shown in FIG. 5, only a few percent of the implanted D stop in the tritide film. Therefore, if the permeation barrier prevents diffusion of D from the substrate to the tritide film, these thin-film targets can have a lifetime longer than the thick-film targets and use only a fraction of the tritium.

The substrate material into which the D is implanted preferably meets the following criteria:

a) The thermal conductivity should be high to avoid thermal desorption of the tritium due to target heating by the beam, b) The diffusivity of D should be high enough at the temperature of operation to avoid accumulation of high concentrations at the depth of implantation.

c) The solubility for deuterium should not be too low, so that the implanted D does not precipitate into gas bubbles, which tends to occur when D is implanted into materials in which the solubility and diffusivity of D are both low. $D_2$ gas bubble growth and coalescence can result in exfoliation of the tritide film.

d) Solubility of T in the substrate material should be low so that the titanium tritide film can be loaded by thermal equilibration with tritium gas at high temperature, without also excessively loading the substrate material.

Figure 6:
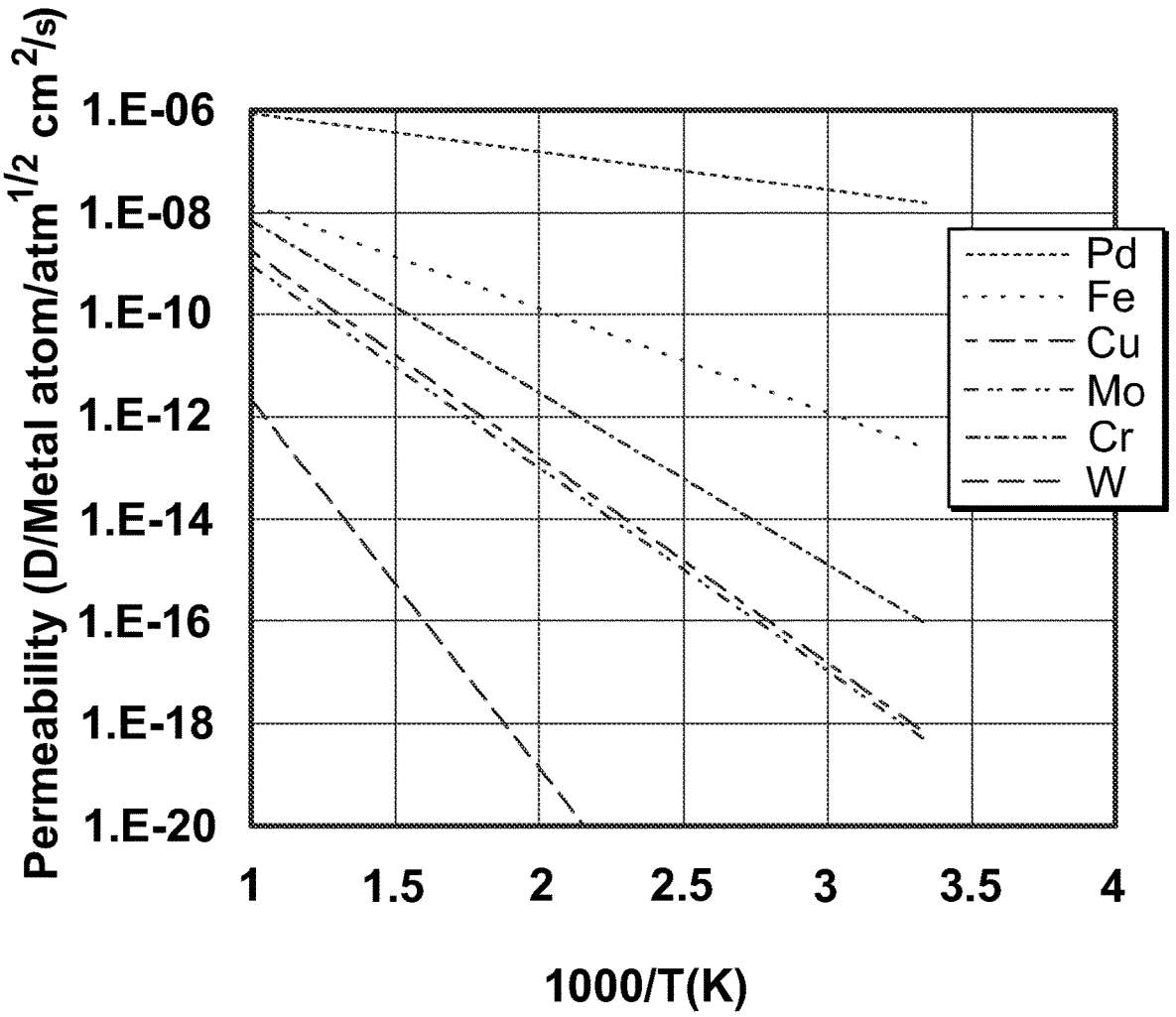
FIG. 6 is a graph of permeability of deuterium in various metals vs reciprocal temperature.

In addition, the permeability of D should be high in the substrate and low in the barrier material. Permeability is the product of solubility and diffusivity. Table 1 and FIG. 6 summarize the solubility S, diffusivity D, and permeability P=SD of deuterium (or hydrogen) for a few candidate materials in the limit of low concentration, parameterized as a prefactor and thermal activation energy:

$$S=S_o \exp(-Q_S/kT),$$

$$D=D_o \exp(-Q_D/kT).$$

One caveat is that measurements of solubility and diffusivity are often made at higher temperatures, particularly for the low-permeability refractory materials, so extrapolation to the lower temperatures of interest here (approximately 30 to 150° C.) can introduce uncertainty. Therefore, data on solubility and diffusivity can be used as a qualitative guide for material selection, but probably not for quantitative prediction of thin-film target performance.

TABLE 1

Prefactor and activation energy for solubility and diffusivity of D (or H) in material.

| Material | $D_0$ ($cm^2/s$) | $Q_D$ (eV) | $S_0$ (at frac)/$atm^{1/2}$ | $Q_S$ (eV) |
|---|---|---|---|---|
| Pd | 2.90E−03 | 0.23 | 0.0017 | −0.082 |
| Ni | 5.27E−03 | 0.401 | 0.0016 | 0.147 |
| Cu | 7.30E−03 | 0.382 | 0.0024 | 0.415 |
| Mo | 2.40E−04 | 0.109 | 0.0357 | 0.678 |
| Fe | 7.50E−04 | 0.105 | 0.002 | 0.297 |
| Cr | 3.00E−04 | 0.077 | 0.051 | 0.59 |
| Co | 9.30E−04 | 0.241 | 0.0019 | 0.239 |
| W | 4.10E−03 | 0.39 | 0.0089 | 1.042 |

See N. R. Quick and H. H. Johnson, *Acta. Metall.* 26, 903 (1978); J. Volkl and G. Alefeld, "Hydrogen in Metals I: Basic Properties," *Topics in Applied Physics Vol* 28, Springer Verlag (1978); R. Frauenfelder, *J. Vacuum Sci. Technol.* 6, 388 (1969); and "The Diffusion of H, D and T in Solid Metals," Chapter 9 pgs 504-573 of *Diffusion in Solid Metals and Alloys*, editor H. Mehrer, Springer Verlag, Heidelberg, 1990.

Figure 7:
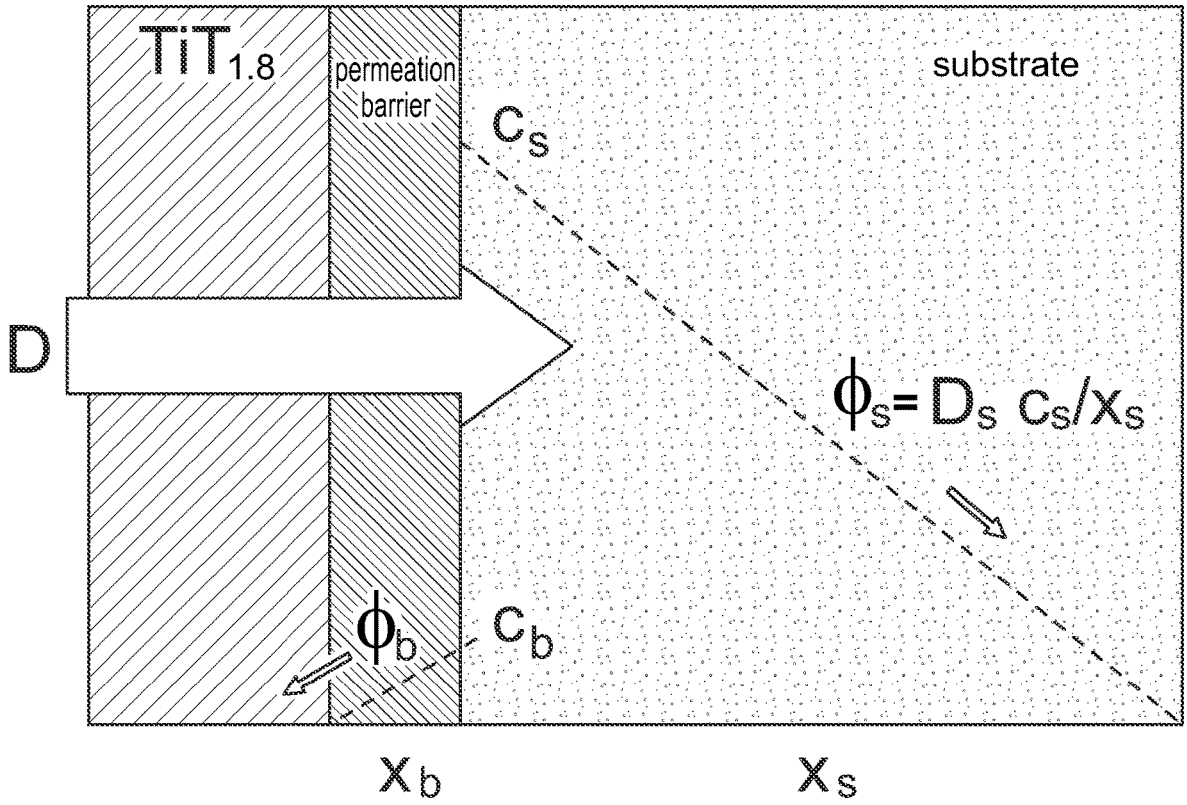
FIG. 7 is a schematic illustration of the permeation model for the relative flux of D through the permeation barrier and substrate giving Eq. (4).

A permeation model, helpful in guiding selection of materials, is illustrated in FIG. 7. The dashed lines schematically illustrate the steady-state concentration of D diffusing through the permeation barrier to the tritide ($c_b$) and to the back of the substrate ($c_s$). The ratio of D fluxes through the barrier and substrate is given by:

$$\frac{\phi_b}{\phi_s} = \frac{\frac{c_b D_b}{x_b}}{\frac{c_s D_s}{x_s}} = \frac{x_s}{x_b}\frac{P_b}{P_s} \tag{4}$$

where $D_b$ and $D_s$ are the diffusion coefficients of D in the barrier and substrate materials, respectively. Since the concentrations $c_b$ and $c_s$ of D on either side of the interface are in local thermal equilibrium, their ratio is equal to the ratio of their solubilities. The ratio of fluxes $\phi_b/\phi_s$ is therefore given by the ratio of D permeability $P_b/P_s$ divided by the ratio of thickness $x_b/x_s$ of the barrier and substrate. With barrier and substrate thicknesses of 0.1 μm and 0.1 cm, the requirement on permeabilities for a thin-film target to have a longer lifetime than a 10× thicker thick-film target becomes $P_b/P_s<10^{-5}$ (i.e. less than 10% of the implanted D permeates through the barrier to the tritide film). This is a demanding criterion for a permeation barrier but can be achieved as shown in FIG. 6. For example, at a target temperature of 60° C. or 1000/T(K)=3.0, Cr can be an adequate barrier material on a Pd substrate, but not on an Fe substrate. With an Fe substrate, Mo or Cu could be adequate barrier materials, but W should be much better. One potential pitfall is that imperfections in the barrier layer, such as variations in thickness due to surface roughness, might increase permeation locally and reduce the net performance of the barrier. Another concern is whether lattice displacement by the D ion irradiation can cause mixing of the barrier and substrate materials. However, mixing was found to be insignificant as demonstrated by Rutherford backscattering on targets before and after use. Another important advantage is that thin-film targets do not need to be heated during use as do thick-film targets. On the contrary, the ratio of permeation in substrate to barrier increases with decreasing temperature, so thin-film target performance improves with decreasing temperature, which was experimentally verified.

Tests of thin-film targets with various materials were conducted. Initially, Pd and Cr were identified as potential materials for substrate and barrier. However, tests with Pd substrate showed that the higher solubility of tritium in Pd resulted in excessively high concentration of tritium in solution in the Pd substrate and slow release of tritium during handling of the target. This risk was eliminated by using Fe for the substrate material, which has much lower tritium solubility. However, because of the lower permeability of Fe compared to Pd, the permeability of the barrier material must also be lower, as specified by Eq. (4). Therefore, targets with an Fe substrate and a W or Mo permeation barrier were tested. All target material combinations were fabricated first as deuterium-loaded targets to confirm good film adhesion before fabricating tritium-loaded targets, to avoid potential contamination from tritiated particulates in the event of film exfoliation. Since the performance of thin-film targets is sensitive to the thickness of the films, the film thicknesses were verified by Rutherford backscattering to be within 10% of the requested values prior to tritium loading.

Figure 8:
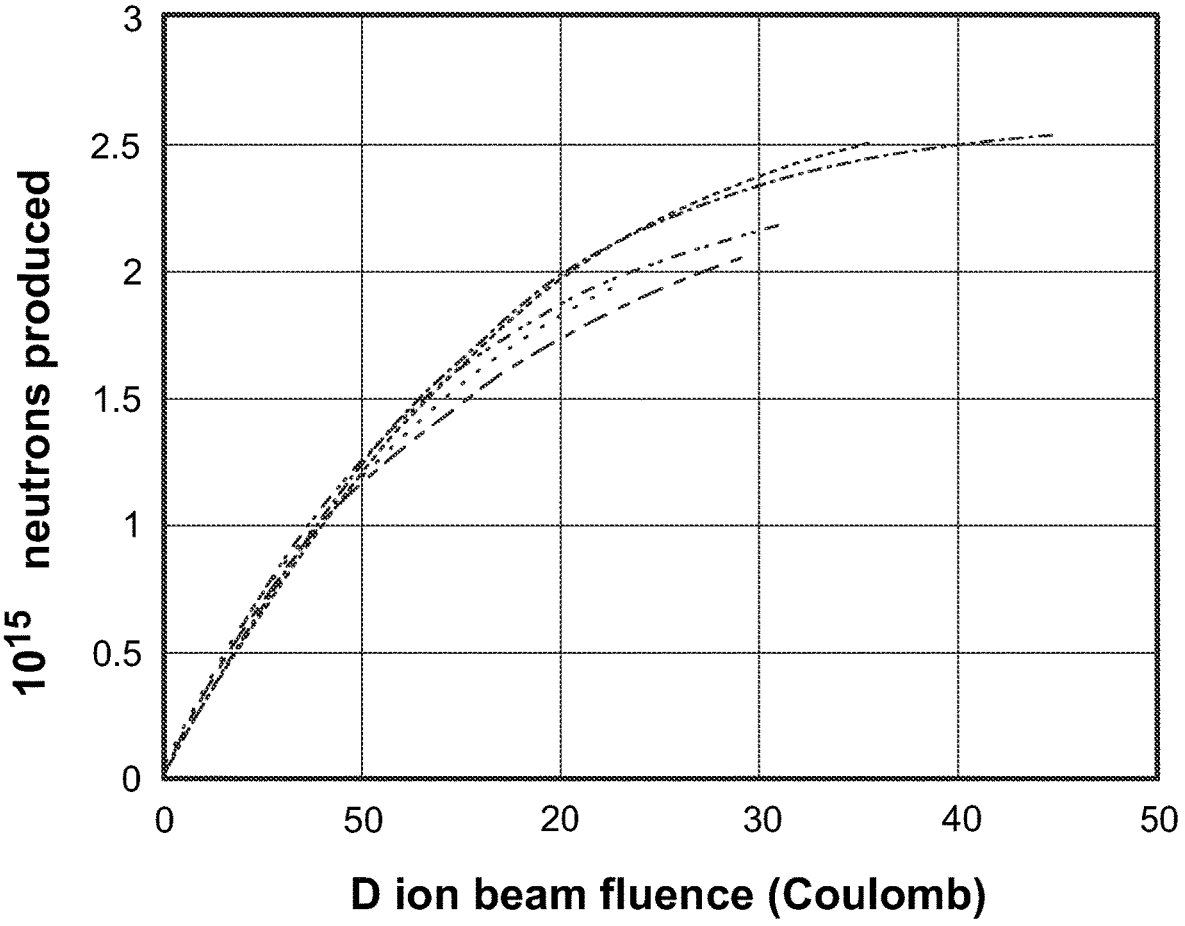
FIG. 8 is a graph of neutron yield vs integrated beam current. Solid lines show data from four thick-film targets and dashed lines show data from six thin-film targets with a W permeation barrier and an Fe substrate.

FIG. 8 shows a representative selection of target test results as the cumulative number of neutrons produced vs integrated D ion beam current, which is proportional to the number of incident D atoms. Plotting neutron yield versus integrated beam current instead of elapsed time facilitates comparison between targets by removing intervals when the beam was off, which varied from target to target. Neutron production was determined from the yield of associated alpha particles. Beam current was measured on the target as well as upstream into a Faraday cup with secondary electron suppression. Precision of the measurements of neutron yield and beam current are within 10%. The neutron yield was independently confirmed by foil activation dosimetry. See *Standard Test Method for Measuring Neutron Fluence and Average Energy from* $^{3}H(d,n)^{4}He$ *Neutron Generators by Radioactivation Techniques*, ASTM E496-14. The solid lines show results from three thick-film targets and the dashed lines show results for two thin-film targets with an Fe substrate and W permeation barrier. The thick-film targets gave a total of about $2\times10^{15}$ neutrons per target. The thin film targets gave $2.5\times10^{15}$ neutrons, exceeding the performance of the thick-film targets.

The present invention has been described as a thin-film target for DT neutron production. It will be understood that the above description is merely illustrative of the applications of the principles of the present invention, the scope of which is to be determined by the claims viewed in light of the specification. Other variants and modifications of the invention will be apparent to those of skill in the art.

We claim:

1. A thin-film target for DT neutron production, comprising:

an iron substrate having a high D permeability, a tungsten permeation barrier layer having a low D permeability on the iron substrate to inhibit D permeation from the iron substrate therethrough, and a front-surface tritide layer on the tungsten permeation barrier layer that reacts with an incident D beam to produce DT neutrons, wherein the combined thickness of the tritide layer and the tungsten permeation barrier layer is less than the range of an incident D beam having an energy.

2. The thin-film target of claim 1, wherein the combined thickness of the tritide layer and the tungsten permeation barrier layer if less than 50% of the range of the incident D beam.

3. The thin-film target of claim 2, wherein the combined thickness is less than approximately 10% of the range of the incident D beam.

4. The thin-film target of claim 1, wherein the tritide comprises a metal tritide.

5. The thin-film target of claim 4, wherein the metal tritide comprises titanium tritide.

* * * * *